US006980168B1

(12) United States Patent
Lebaric

(10) Patent No.: US 6,980,168 B1
(45) Date of Patent: Dec. 27, 2005

(54) ULTRA-WIDEBAND ANTENNA WITH WAVE DRIVER AND BEAM SHAPER

(75) Inventor: Jovan E. Lebaric, Carmel, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/721,594

(22) Filed: Nov. 25, 2003

(51) Int. Cl.[7] ..... H01Q 13/00; H01Q 1/00
(52) U.S. Cl. ..... 343/773; 343/774; 343/905
(58) Field of Search ..... 343/907, 908, 343/905, 773, 774, 775, 830, 860; H01Q 13/00, H01Q 1/00

(56) References Cited

U.S. PATENT DOCUMENTS

| | | | | |
|---|---|---|---|---|
| 3,656,166 A * | 4/1972 | Klopach et al. | ..... | 343/756 |
| 4,143,377 A * | 3/1979 | Salvat et al. | ..... | 343/755 |
| 4,225,869 A | 9/1980 | Lohrmann | ..... | 343/773 |
| 4,835,542 A | 5/1989 | Sikina | ..... | 343/802 |
| 4,947,181 A * | 8/1990 | Duncan et al. | ..... | 343/773 |
| 5,134,420 A | 7/1992 | Rosen et al. | ..... | 343/756 |
| 5,140,334 A | 8/1992 | Snyder et al. | ..... | 343/773 |
| 5,534,880 A * | 7/1996 | Button et al. | ..... | 343/774 |
| 5,923,299 A | 7/1999 | Brown et al. | ..... | 343/773 |
| 6,369,766 B1 * | 4/2002 | Strickland et al. | ..... | 343/713 |

OTHER PUBLICATIONS

W.L. Barrow et al., Biconial Electromagnetic Horns, Proceeding of the I.R.E., Dec. 1939, pp769-779.

* cited by examiner

*Primary Examiner*—Trinh Vo Dinh
(74) *Attorney, Agent, or Firm*—Peter A. Lipovsky; Michael A. Kagan; Allan Y. Lee

(57) ABSTRACT

An antenna comprises an antenna feed line having first and second conductors. It also comprises an antenna driver section having a pair of opposing cones. Each of the cones has an apex region and the cones are arranged so that the apex regions are spaced apart and are adjacent. One of the cones is connected to the first conductor and a second of the cones is connected to the second conductor. The antenna also comprises an antenna beam shaper section. This section has a beam shaper element with a beam shaping surface chosen to provide selected antenna operating characteristics and also has a conforming surface that is in substantial conformity with a crotch defined between the two cones.

26 Claims, 16 Drawing Sheets

ULTRA-WIDEBAND ANTENNA WITH WAVE DRIVER AND BEAM SHAPER

BACKGROUND

The ensuing description relates generally to ultra-wideband antennas.

SUMMARY

An antenna comprises an antenna feed line having first and second conductors. It also comprises an antenna driver section having a pair of opposing cones. Each of the cones has an apex region and the cones are arranged so that the apex regions are spaced apart and are adjacent. One of the cones is connected to the first conductor and a second of the cones is connected to the second conductor. The antenna also comprises an antenna beam shaper section. This section has a beam shaper element with a beam shaping surface chosen to provide selected antenna operating characteristics and also has a conforming surface that is in substantial conformity with a crotch defined between the two cones.

Other objects, advantages and new features will become apparent from the following detailed description when considered in conjunction with the accompanied drawings.

BRIEF DESCRIPTION OF THE DRAWINGS

FIGS. 1A and 11B illustrate perspective and cross-sectional views, respectively, of an example antenna.

DESCRIPTION

An antenna uses a combination of shapes and materials to achieve operational results. A selectively shaped structure comprises a "wave driver" section of the antenna and is used to extract electromagnetic energy from an antenna feed line. This energy is then launched into a "beam-shaper" section of the antenna that is of a shape chosen to effectuate selected antenna operating characteristics.

An example material for the wave driver section of the antenna is a conducting metal. An example material for the beam shaper section of the antenna is a dielectric.

Impedance matching control is effectuated via the wave driver section of the antenna. The self-balanced antenna has no ground plane, baluns or impedance transformers. The beam shaper section of the antenna allows matching of an outgoing wave to the free-space propagating plane wave of the antenna while also allowing selected focusing of the antenna radiation. The impedance matching control and beam shaping capabilities are independent, allowing a variety of antenna operating shapes (radiation patterns) without compelling an alteration in impedance matching.

Figure 1A:
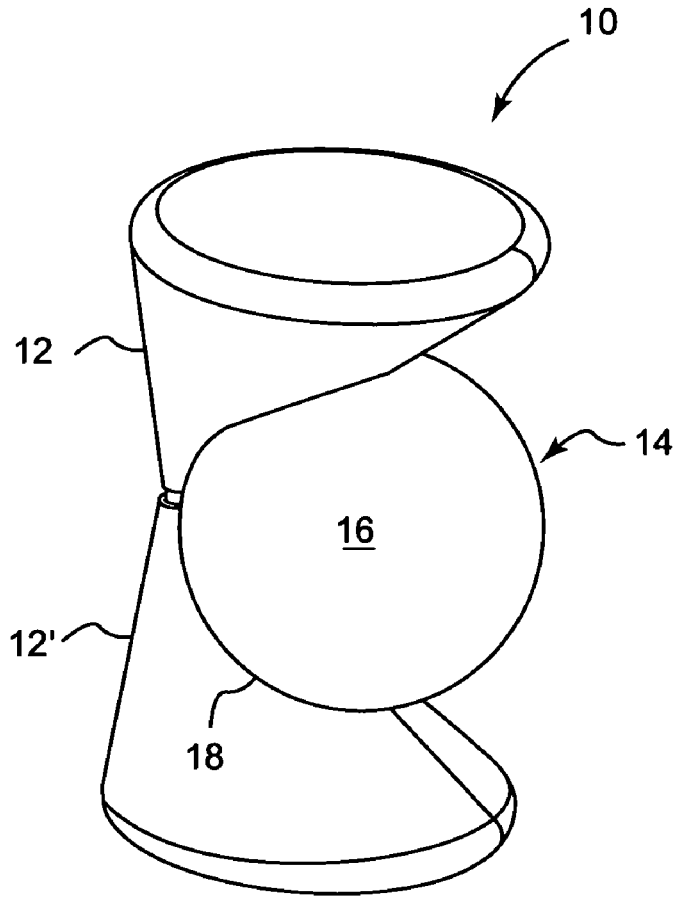

Referring to FIG. 1A, an example antenna 10 is shown. Antenna 10 includes a wave driver section comprising cones 12 and 12'. A beam shaper section of antenna 10 includes a beam shaper element 14 comprising a beam shaper surface 16 and a conforming surface 18 that is in substantial conformity with a crotch defined between cones 12 and 12' and beam shaper element 14.

As will be further disclosed herein, a wide variety of wave driver section shapes and beam shaper section shapes are possible to provide, respectively, both impedance matching and selected beam shaping or focusing. In the example shown in FIG. 1A, cones 12 and 12' are asymmetric and are substantially identical oblique circular cones that are disposed in a reflectively opposing manner. Such identical cones permit the peak of the antenna beam to be in the symmetry plane (a horizontal direction for example). The beam shaper surface 16 of this example antenna is convex and more specifically is substantially spherical. Such a spherical beam shaping surface tends to provide a rotationally symmetric (i.e. "pencil") beam.

For this specific embodiment, as well as other embodiments of this antenna, the cones may be either hollow or solid. A conducting metal has been used as a material for these cones. A dielectric has been used as a material for beam shaper section 14 of antenna 10. This section can be either solid or hollow. A variety of dielectrics are considered suitable depending upon antenna operating characteristics desired. For example, beam shaper section 14 may be constructed of a polymer such as polyethylene or nylon.

Figure 1B:
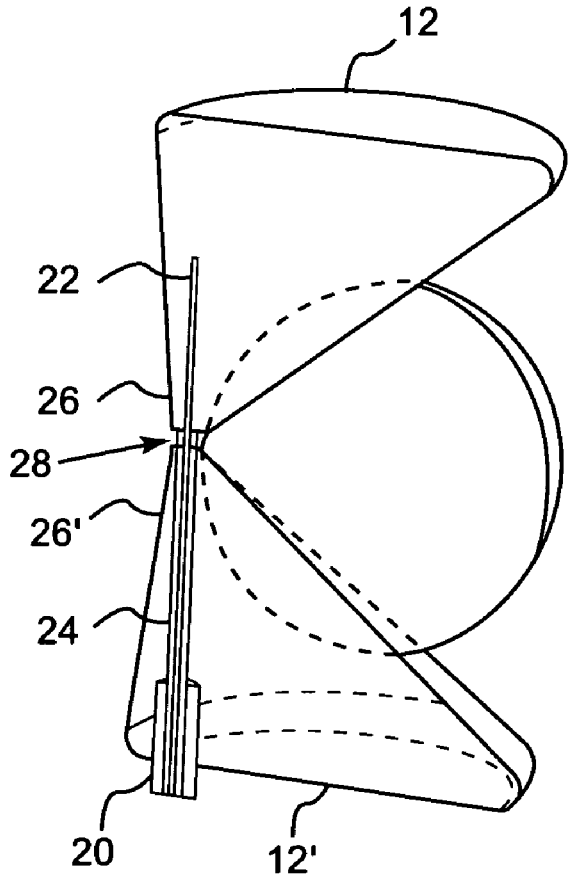

In FIG. 1B, a cross-section of antenna 10 of FIG. 1A is shown. In this cross-section it can be seen that an antenna feed 20 is illustrated. Feed 20 has first 22 and second 24 conductors that are operably connected to cones 12 and 12', respectively. The center conductor of this feed, conductor 22, can be of a material such as brass rod cut to a suitable length. In this figure it can be easily seen that cones 12 and 12' have apex regions 26 and 26' that are arranged to be adjacent but that are separated (spaced-apart) at region 28.

Figure 2:
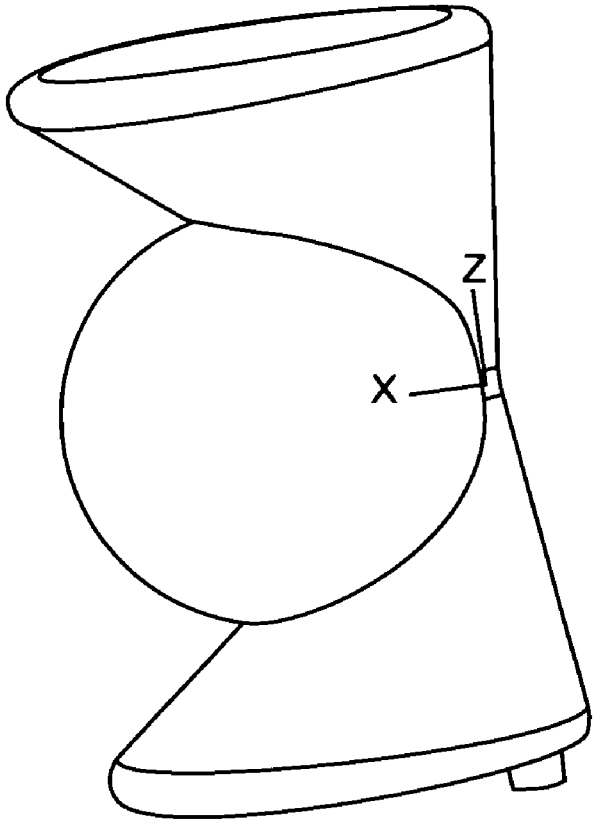
FIG. 2 shows another perspective view of the example antenna of FIG. 1.
Figure 3A:
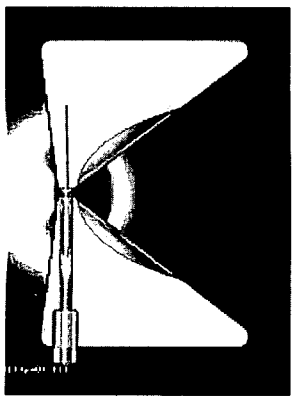
FIGS. 3A–3J illustrates a wavefront progression from Gaussian pulse excitation.
Figure 3B:
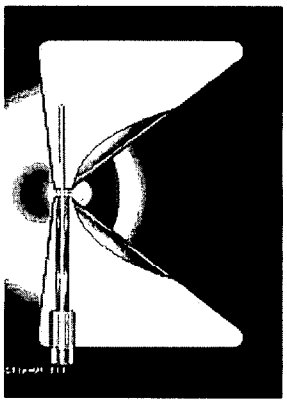
Figure 3C:
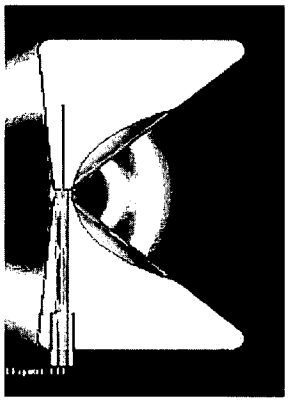
Figure 3D:
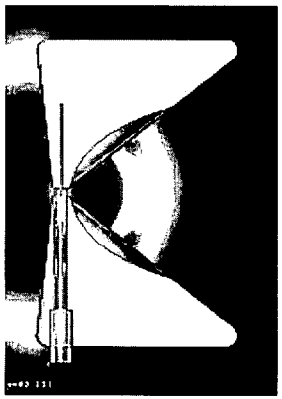
Figure 3E:
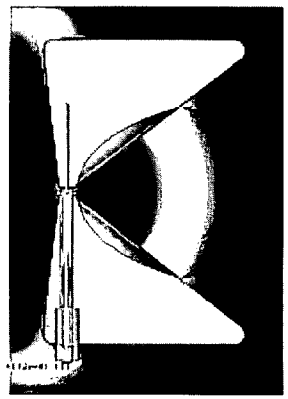
Figure 3F:
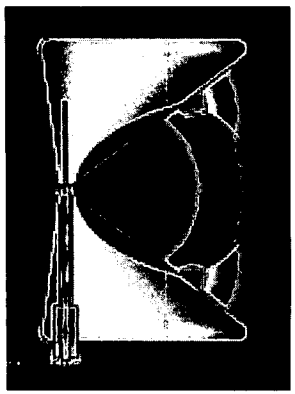
Figure 3G:
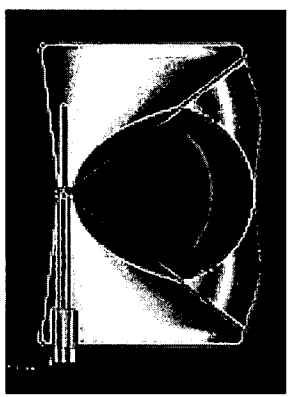
Figure 3H:
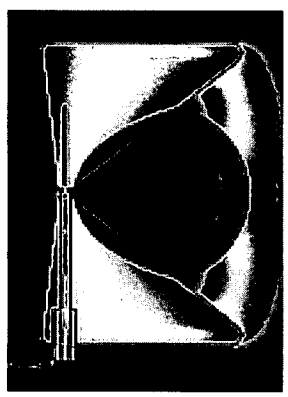
Figure 3I:
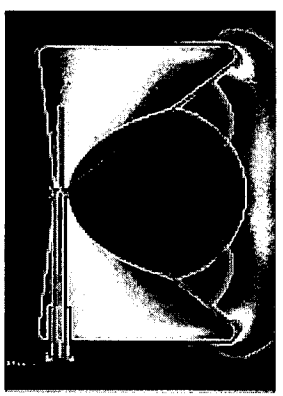
Figure 3J:
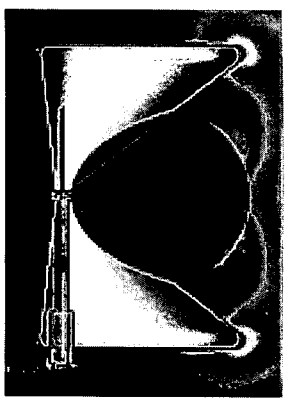

In FIG. 2, another perspective of the example antenna 10 of FIG. 1 is shown. FIG. 2 shows a bore sight "X" and orthogonally arranged cone axis "Z".

Referring now to FIGS. 3A–3J, a wavefront progression from Gaussian pulse excitation is illustrated for various successive points in time after the start of the pulse. The wavefront begins circular, then flattens out, which provides antenna operating directivity. Relative to each other, the sphere has a lower velocity and the air has higher velocity of propagation. In these illustrations, it can be seen that the wavefront begins quickly, then slows down upon reaching the spherical beam shaper. Portions of the wavefront outside the spherical beam shaper, however, continue to advance to the level of the beam shaper, creating a flattened wavefront.

Figure 4A:
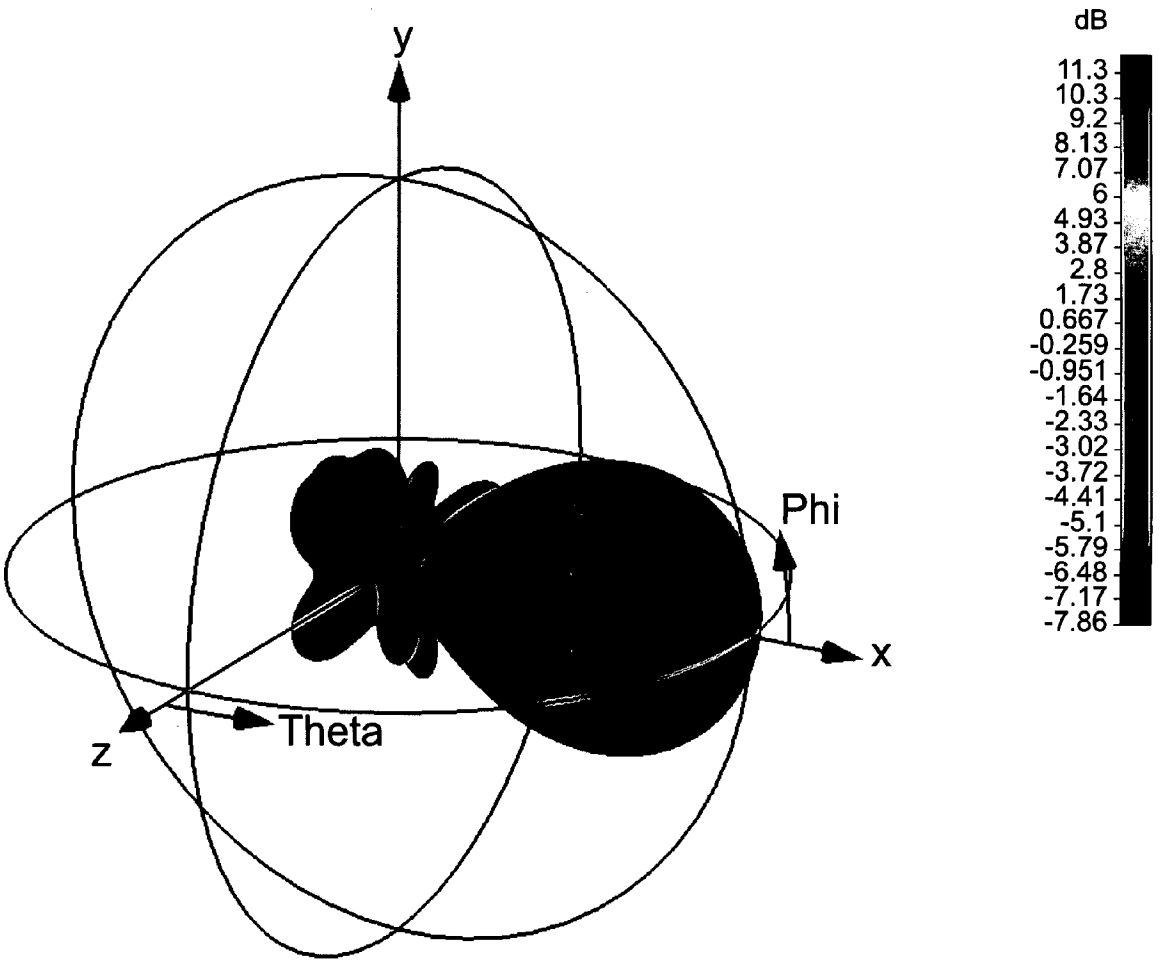
FIGS. 4A–C show three-dimensional radiation patterns at 2.5 G Hz, 5.5 G Hz and 7.5 G Hz, respectively.
Figure 4B:
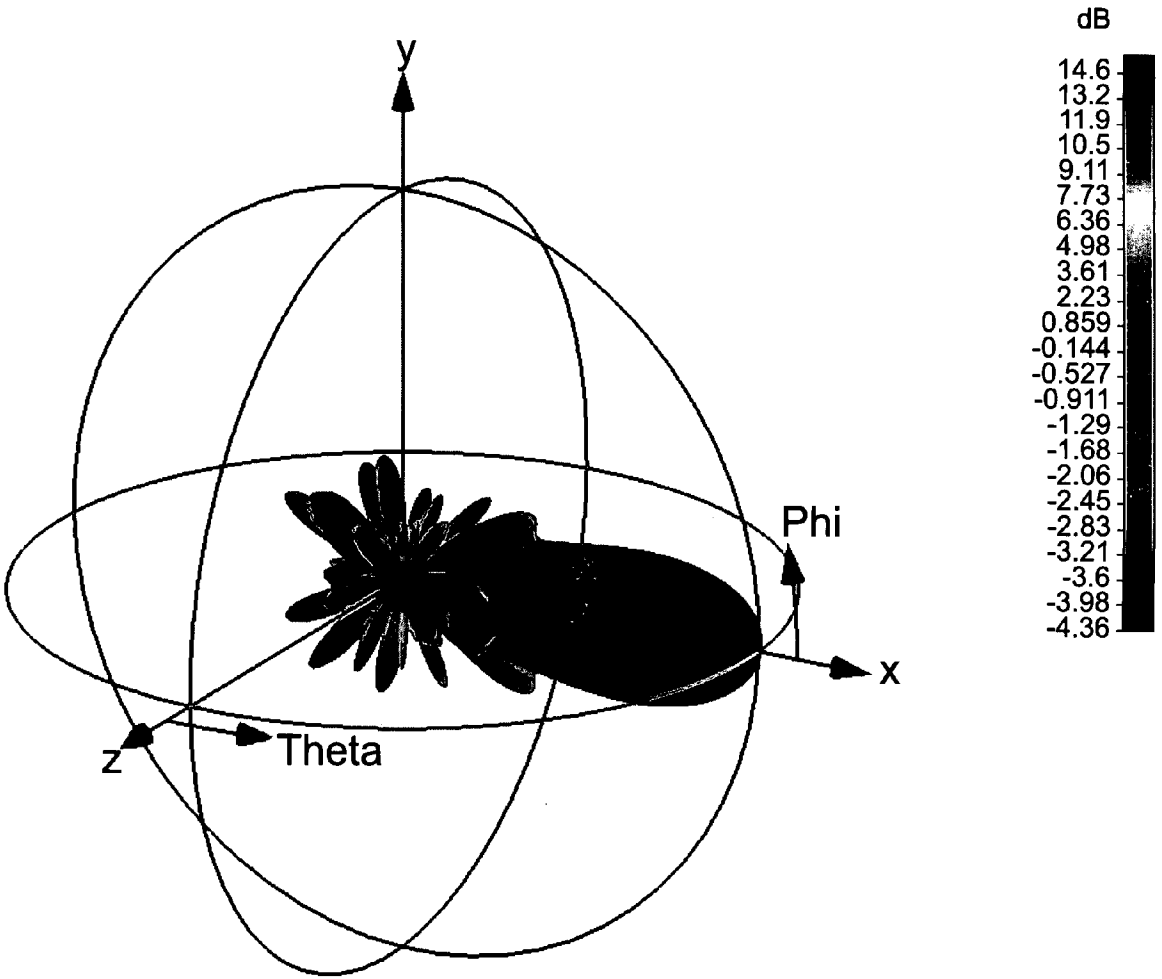
Figure 4C:
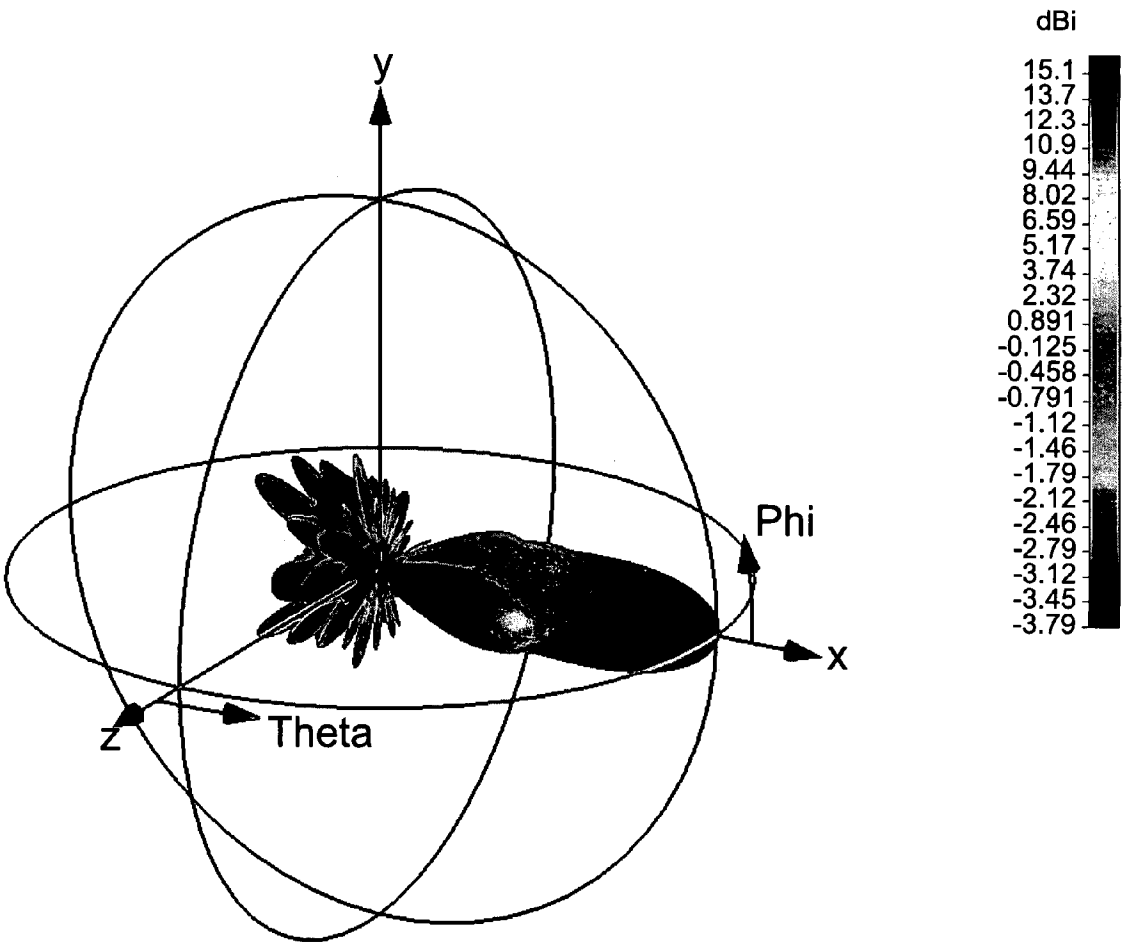

FIGS. 4A–4C illustrate how the antenna permits ultra-wideband operation exhibiting constant aperture characteristics for both transmit and receive functions. In a constant aperture antenna, antenna power received/delivered remains constant with frequency. Such antennas undergo a gain increase with the square of frequency (an increase of 20 dB per decade).

FIGS. 4A–4C are three-dimensional radiation patterns generated at low frequency (2.5 G Hz), FIG. 4A; mid frequency (5.5 G Hz), FIG. 4B; and high frequency (7.5 G Hz), FIG. 4C. These patterns show that antenna gain increases with frequency and that beam-width decreases with frequency.

Figure 5A:
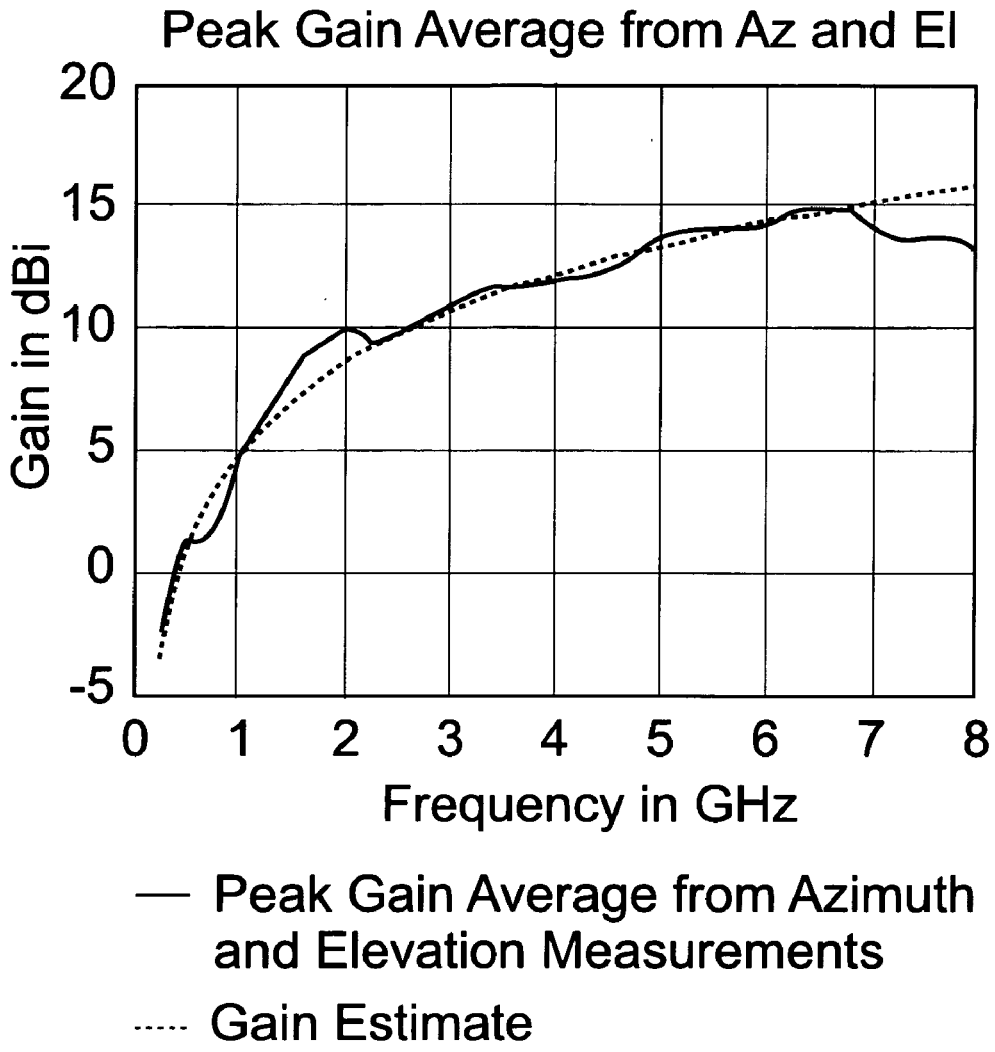
FIGS. 5A–B indicate peak gain average versus frequency.
Figure 5B:
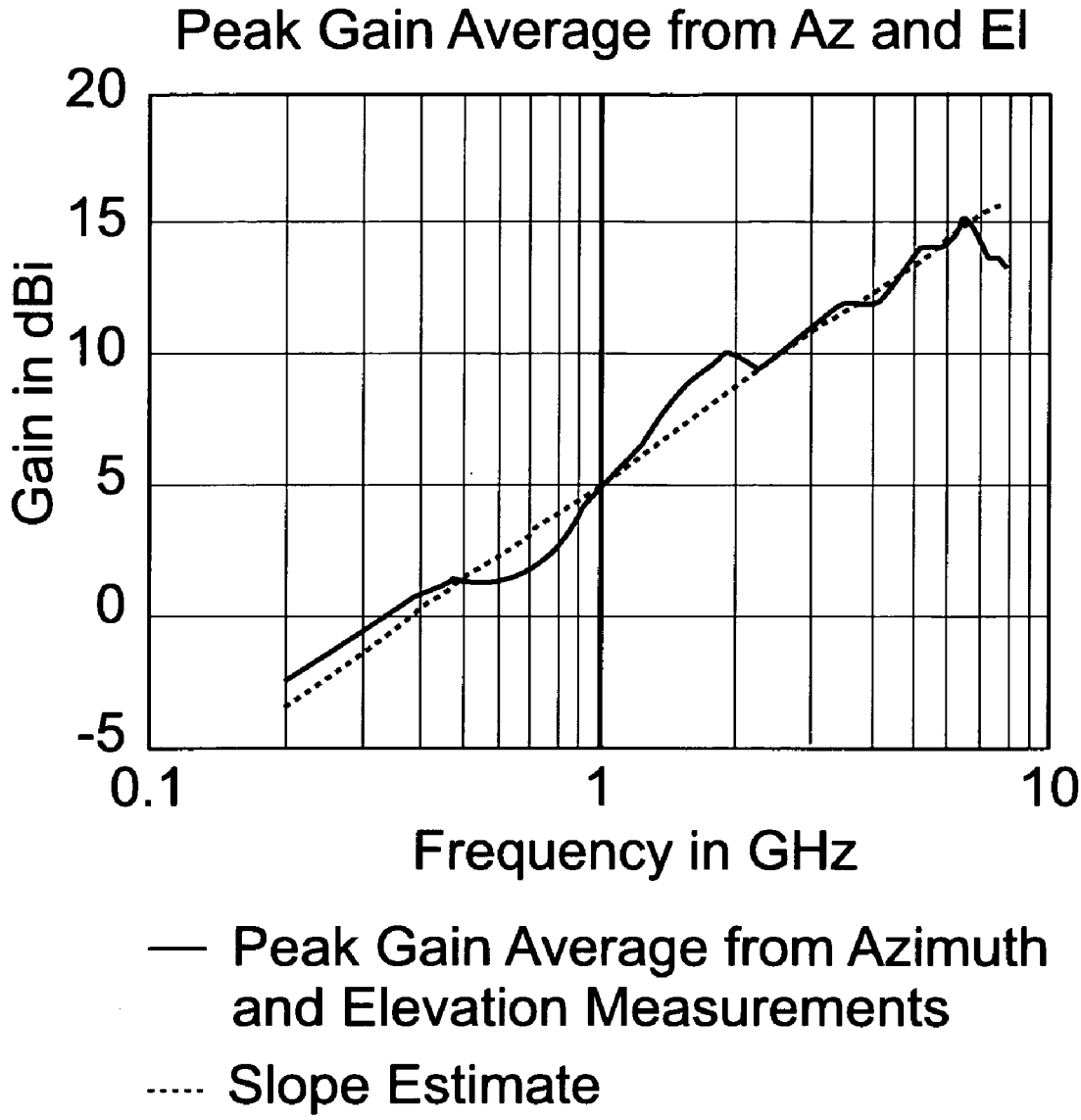

A prototype of the antenna was measured to validate predicted performance. Gain patterns were measured for the plane of azimuth (horizontal or xy-plane) and the principal elevation plane (vertical or xz-plane), where the x-axis coincides with the antenna boresight. The antenna boresight was aligned with the x-axis by determining the azimuth and elevation offsets such that the antenna gain was maximized, to compensate for any mechanical alignment errors. The offsets were adjusted at the highest frequency for each respective set of measurements, based on the fact that the antenna gain angular variation increases with frequency (i.e. "sharper" beams at higher frequencies). The offsets observed were between ~0.5 and ~2.5 degrees, indicating good mechanical alignment in general. Full (360 degree, in 1 degree increments) gain patterns were measured at 584 frequencies between 0.2 and 8 GHz in the azimuth plane, and at 614 frequencies between 0.2 and 8 GHz in the elevation plane FIGS. 5A and 5B are the measured results of the antenna performance (Peak Gain Average from Azimuth (Az) and Elevation (El) Measurements), at different frequencies, showing that the measured results (solid lines) are very close to the simulated predictions (dashed lines), as indicated by the nearness of the measured and estimated outputs shown in these figures.

Figure 6:
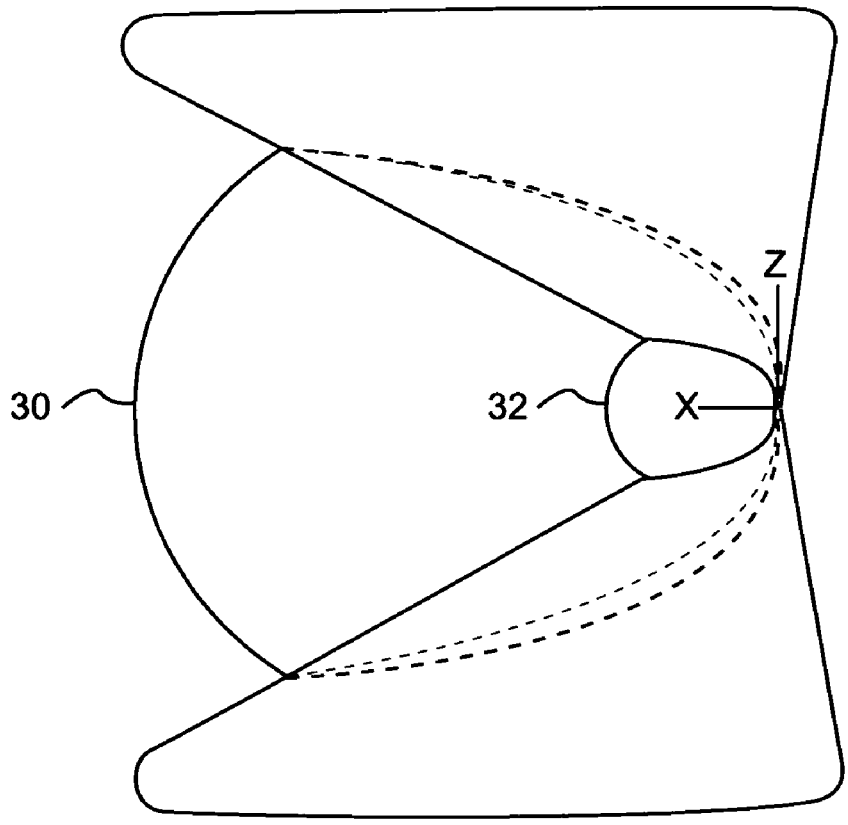
FIG. 6 depicts an alternative embodiment to the antenna of FIG. 1.

Referring now to FIG. 6, another antenna embodiment is shown wherein it can be seen that a first beam shaper element 30 substantially surrounds a second beam shaper element 32. Both beam shaper elements in this example have convex beam shaper surfaces and conforming surfaces substantially conforming to the conical driver elements. A plurality of beam shaping elements, as shown, allows further antenna radiation pattern control. In this variation, beam shaper elements of different dielectric properties are used.

Motivation for this variation is to allow greater gains to be achieved at lower frequencies that the single beam shaper embodiment. The dual beam-shaper embodiment is also designed to provide specified minimum half-power (−3 dB) beam-width at higher frequencies. This design is also designed to minimize weight while optimizing gain (for a desired gain beam-width versus frequency variation).

The smaller beam shaper, with its center closer to the antenna feed, can be used to shape the antenna beam at higher frequencies. Such a beam shaper may be made of a material of relatively high dielectric constant, such as polyethylene. The larger beam shaper, with its center further away from the antenna feed, can be used to shape the beam at lower frequencies. Such a beam shaper may be made of a material with lower dielectric constant, such as polyurethane foam or syntactic foam.

Figure 7:
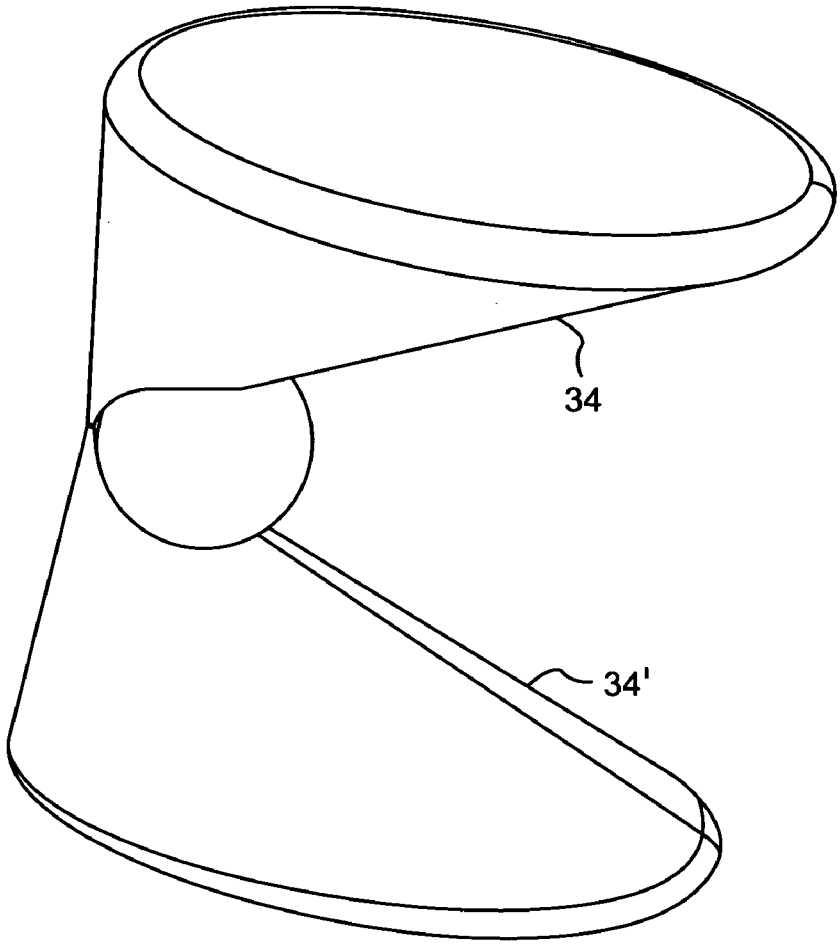
FIG. 7 illustrates an elliptical wave driver embodiment.

In FIG. 7, another embodiment is shown comprising cones 34/34' of elliptical cross-section (oblique elliptical cones). Versus oblique circular cones, a weight reduction is achievable with this elliptical embodiment. This weight reduction is directly proportional to the ratio of the axis of the ellipse. The antenna input impedance also increases with the ellipticity.

Figure 8:
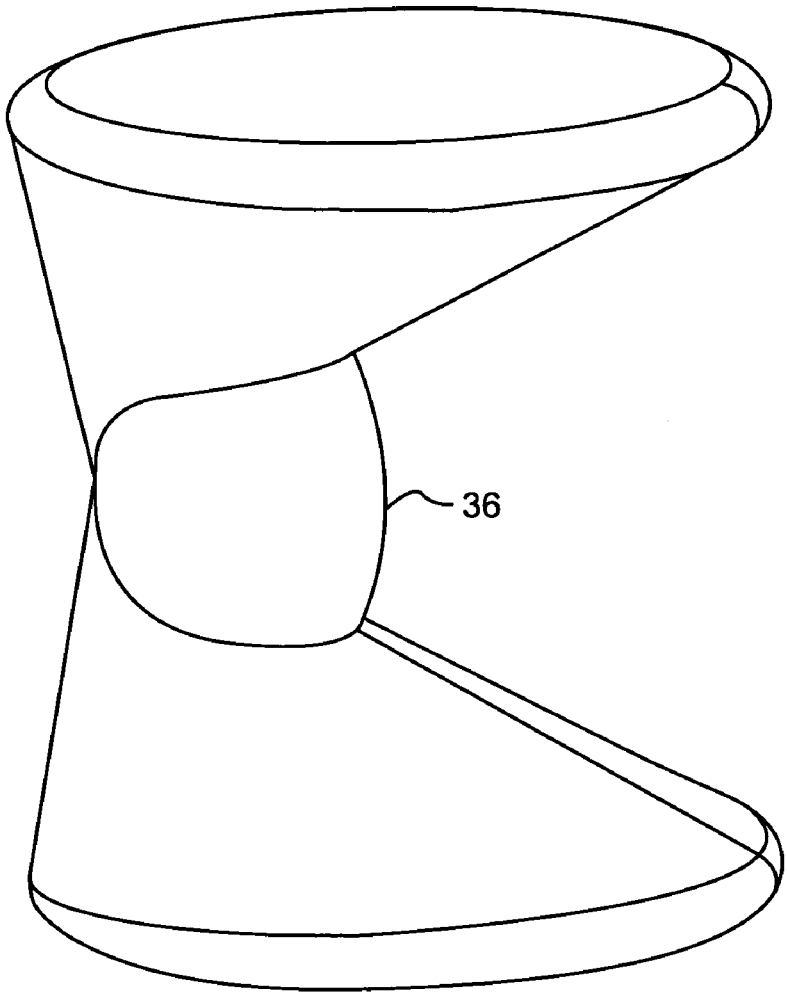
FIG. 8 shows an ellipsoidal beam shaper embodiment.

In FIG. 8, an ellipsoidal beam-shaper element 36 is illustrated. While spherical beam-shapers tend to produce rotationally symmetric ("pencil") beams, a broader beam in one direction may be desired. For example, if a beam broad in elevation and narrow in azimuth (a "fan" beam) is wanted, a beam shaper having a beam shaper surface that is ellipsoidal in shape may be employed. The "ellipsoidal" shape in this instance comes from a body of revolution obtained by rotating an ellipse about its major axis.

Figure 9:
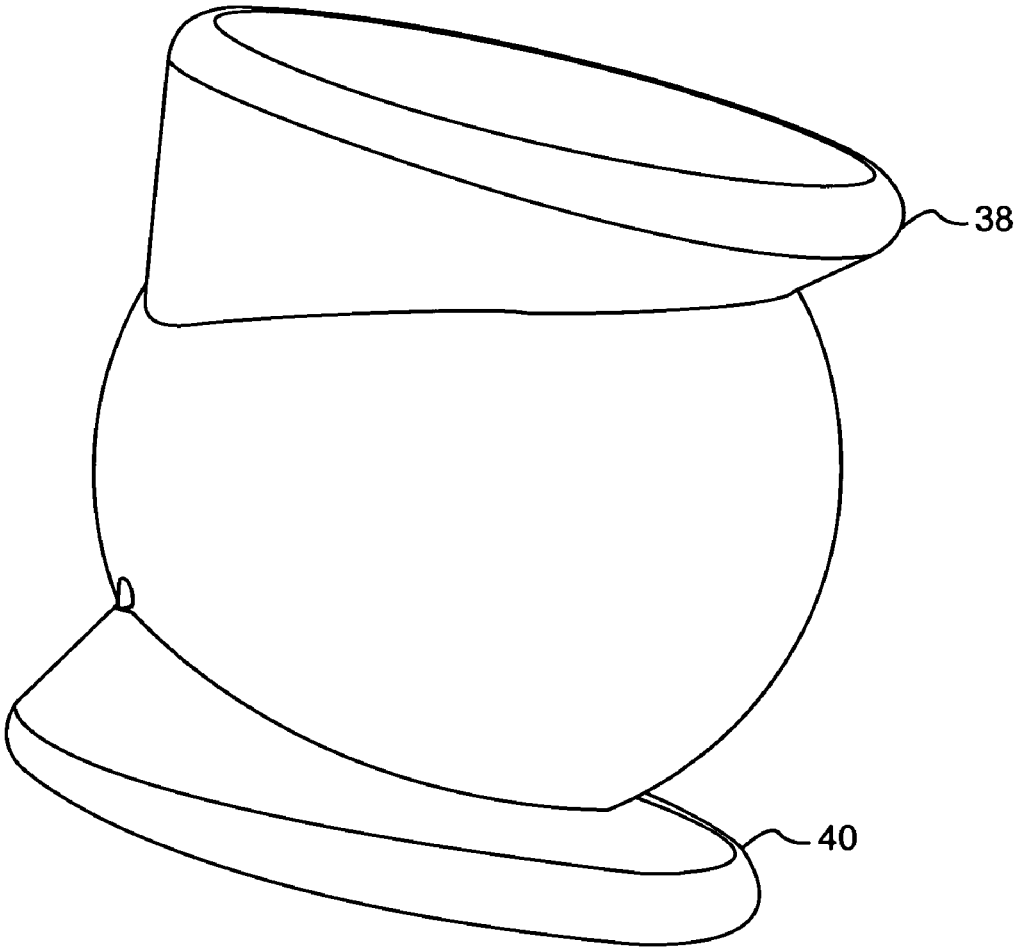
FIG. 9 depicts an asymmetric wave driver embodiment.

FIG. 9 shows an asymmetric wave-driver section variation. In this embodiment, cones 38 and 40 differ. Such an arrangement may be used to change the direction of the antenna's beam. In the instance of identical cones, the beam is in the horizontal direction (the peak of the beam is in the symmetry plane). Where different sized cones are employed, the beam of the antenna will move toward the larger cone.

Figure 10:
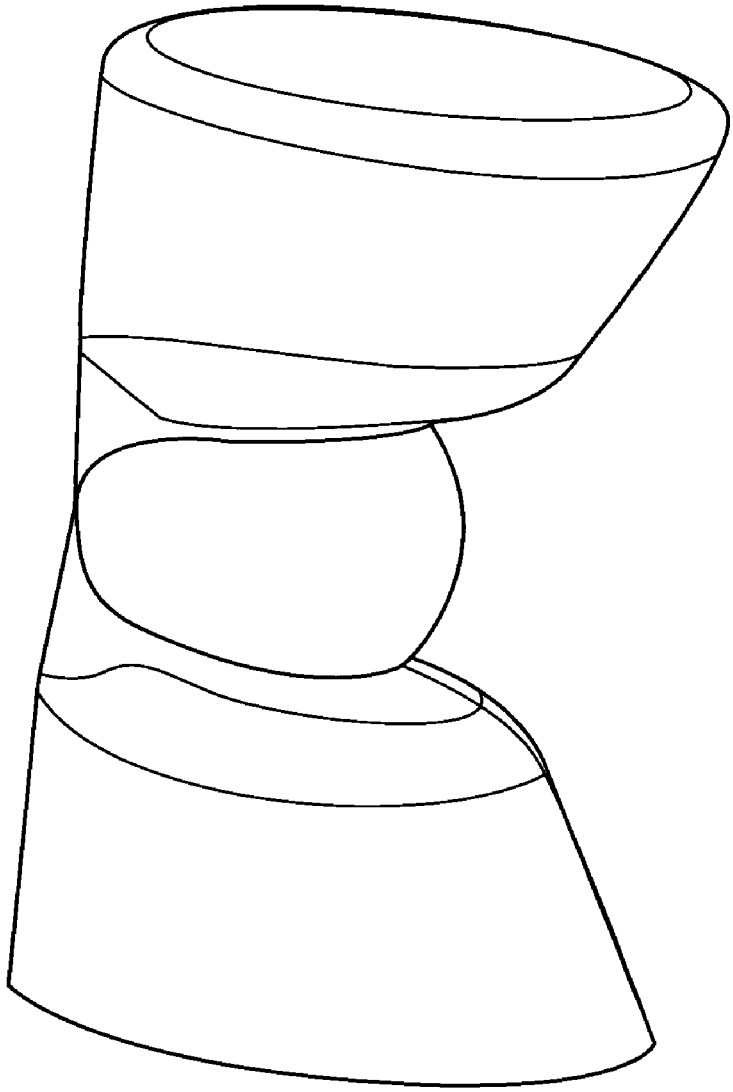
FIG. 10 shows a multi-sloped wave driver embodiment.

FIG. 10 illustrates another antenna embodiment wherein dual sloped cones are employed. Such an arrangement, applicable to one or both utilize cones, is an effective way to reduce the cone diameter. Such an embodiment results in a lower diameter at the expense of some gain reduction at lower frequencies.

Figure 11:
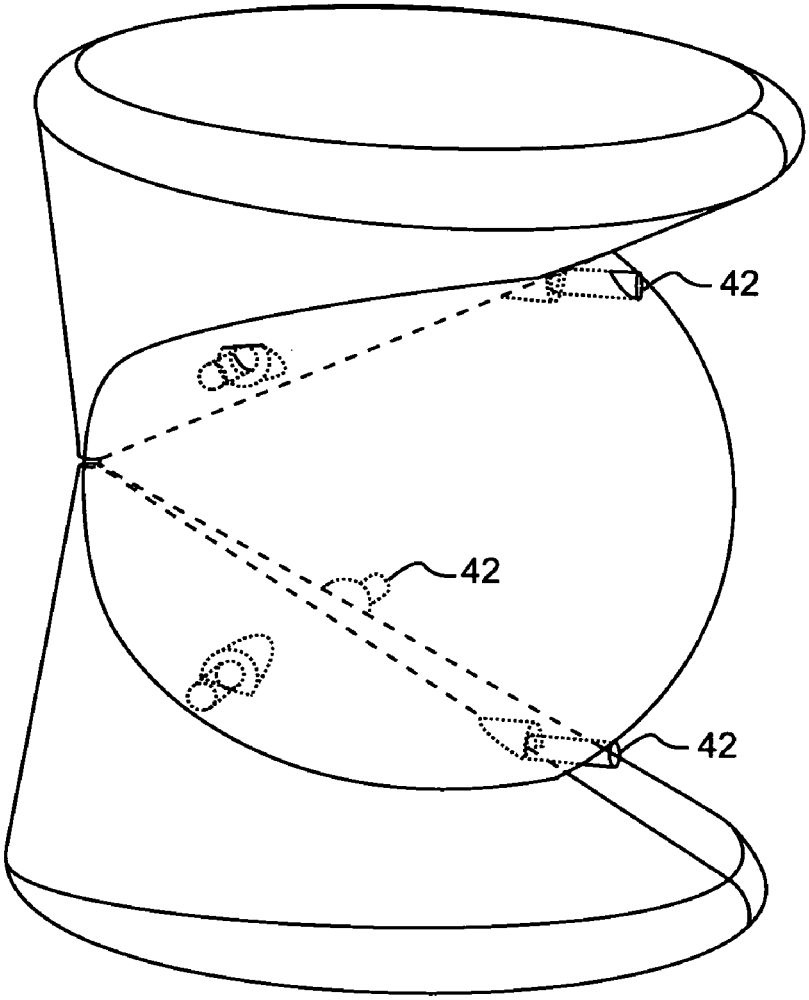
FIG. 11 shows a construction technique.

FIG. 11 shows how bolts/pins 42 may be used as a fastening mechanism to attach a beam shaper section to the wave driver section of the antenna.

Figure 12:
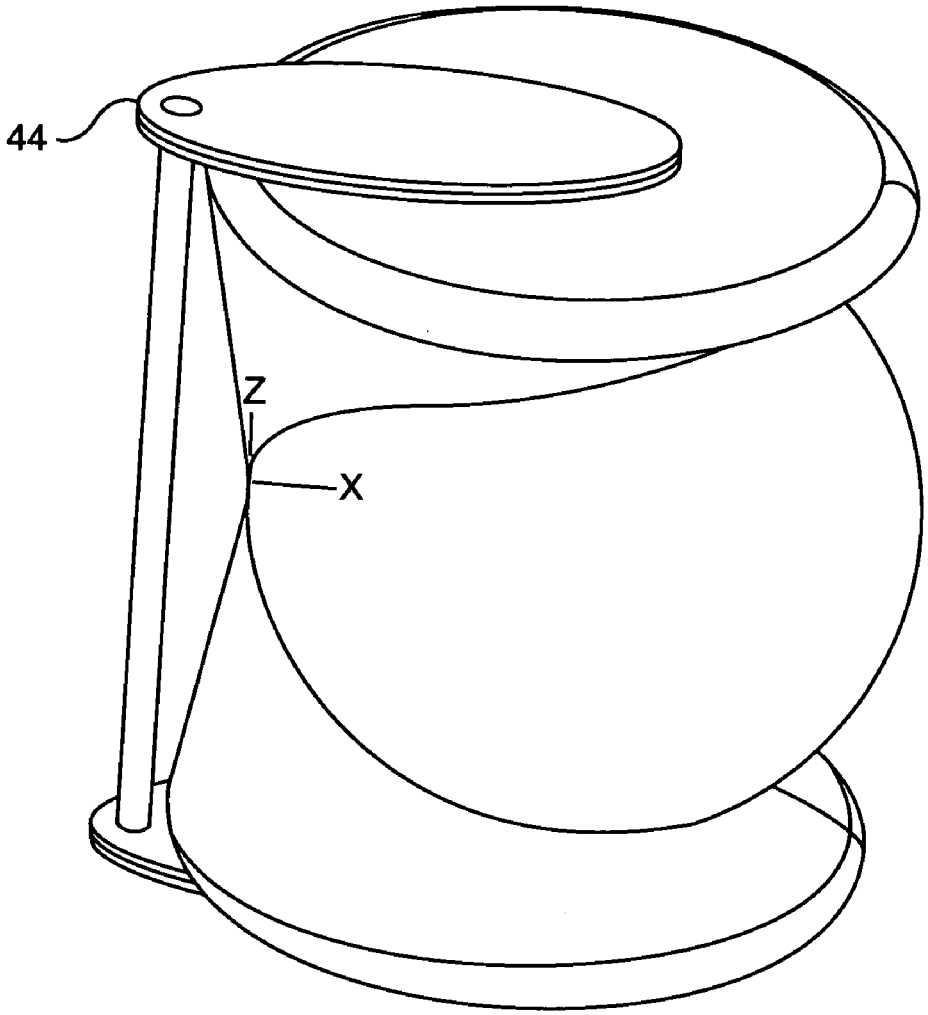
FIG. 12 illustrates another construction technique.

FIG. 12 shows how a clamp 44 may be employed to hold the wave driver and beam shaper sections together.

Obviously, many modifications and variations are possible in light of the above description. It is therefore to be understood that within the scope of the claims the invention may be practiced otherwise than as has been specifically described.

What is claimed is:

1. An antenna apparatus comprising:

an antenna feed line having first and second conductors;

a driver section comprising a pair of cones, each of said cones being asymmetric and having an apex region, said cones arranged so that said apex regions are spaced apart and are adjacent and in which one of said cones is connected to said first conductor and a second of said cones is connected to said second conductor; and a beam shaper section including a beam shaper element having a beam shaper surface of a shape chosen to provide selected antenna operating characteristics and a conforming surface that is disposed in substantial conformity with a crotch defined between said two cones.

2. An antenna apparatus comprising:

an antenna feed line having first and second conductors;

a driver section comprising a pair of oblique cones, each of said cones being asymmetric and having an apex region, said cones arranged so that said apex regions are spaced apart and are adjacent and in which one of said cones is connected to said first conductor and a second of said cones is connected to said second conductor; and a beam shaper section including a beam shaper element having a beam shaper surface of a shape chosen to provide selected antenna operating characteristics and a conforming surface that is disposed in substantial conformity with a crotch defined between said two cones.

3. The apparatus of claim 2 wherein said cones are oblique circular cones.

4. The apparatus of claim 2 wherein said cones are oblique elliptical cones.

5. An antenna apparatus comprising:

an antenna feed line having first and second conductors;

a driver section comprising a pair of cones wherein at least one of said cones has a plurality of slope faces, each of said cones having an apex region, said cones arranged so that said apex regions are spaced apart and are adjacent and in which one of said cones is connected to said first conductor and a second of said cones is connected to said second conductor; and a beam shaper section including a beam shaper element having a beam shaper surface of a shape chosen to provide selected antenna operating characteristics and a conforming surface that is disposed in substantial conformity with a crotch defined between said two cones.

6. The apparatus of claim 5 wherein said cones differ in slope faces.

7. An antenna apparatus comprising:

an antenna feed line having first and second conductors;

a driver section comprising a pair of cones, each of said cones having an apex region, said cones arranged so that said apex regions are spaced apart and are adjacent and in which one of said cones is connected to said first conductor and a second of said cones is connected to said second conductor; and a beam shaper section including a beam shaper element having a convex beam shaper surface that is substantially spherical to provide selected antenna operating characteristics and a conforming surface that is disposed in substantial conformity with a crotch defined between said two cones.

8. An antenna apparatus comprising:

an antenna feed line having first and second conductors;

a driver section comprising a pair of cones, each of said cones having an apex region, said cones arranged so that said apex regions are spaced apart and are adjacent and in which one of said cones is connected to said first conductor and a second of said cones is connected to said second conductor; and a beam shaper section including a beam shaper element having a convex beam shaper surface that is substantially ellipsoidal to provide selected antenna operating characteristics and a conforming surface that is disposed in substantial conformity with a crotch defined between said two cones.

9. An antenna apparatus comprising:

an antenna feed line having first and second conductors;

a driver section comprising a pair of cones, each of said cones having an apex region, said cones arranged so that said apex regions are spaced apart and are adjacent and in which one of said cones is connected to said first conductor and a second of said cones is connected to said second conductor; and a beam shaper section including a beam shaper element having a beam shaper surface of a shape chosen to provide selected antenna operating characteristics and a conforming surface that is disposed in substantial conformity with a crotch defined between said two cones, wherein said beam shaper element is a first of first and second beam shaper elements wherein said first beam shaper element substantially surrounds said second beam shaper element, each of said beam shaper elements having different dielectric properties.

10. An antenna apparatus comprising:

an antenna feed line having first and second conductors;

a driver section comprising a pair of cones, each of said cones being asymmetric and having an apex region, said cones arranged so that said apex regions are spaced apart and are adjacent and in which one of said cones is connected to said first conductor and a second of said cones is connected to said second conductor; and a beam shaper section including a beam shaper element having a beam shaper surface that is convex and a conforming surface that is disposed in substantial conformity with a crotch defined between said two cones.

11. The apparatus of claim 10 wherein said cones are oblique cones.

12. The apparatus of claim 11 wherein said cones are oblique circular cones.

13. The apparatus of claim 11 wherein said cones are oblique elliptical cones.

14. The apparatus of claim 10 wherein said shape of said beam shaper surface is substantially spherical.

15. The apparatus of claim 10 wherein said shape of said beam shaper surface is substantially ellipsoidal.

16. The antenna apparatus of claim 10 wherein said beam shaper element is of a material comprising a dielectric.

17. The antenna apparatus of claim 10 wherein said beam shaper element is a first of first and second beam shaper elements wherein said first beam shaper element substantially surrounds said second beam shaper element, each of said beam shaper elements having different dielectric properties.

18. The apparatus of claim 17 wherein said beam shaper surface of said first beam shaper element is substantially convex and further wherein said second beam shaper element has a beam shaper surface that is substantially convex and has a conforming surface that is disposed in substantial conformity with said crotch defined between said two cones.

19. The antenna apparatus of claim 17 wherein said first beam shaper element is of foam and said second beam shaper element is of polyethylene.

20. An antenna apparatus comprising:

a coaxial antenna feed line having first and second conductors;

an antenna driver section having a pair of reflectively opposing, substantially identical, asymmetric cones, each of said cones having an apex region, said cones arranged so that said apex regions are spaced apart and are adjacent and in which one of said cones is connected to said first conductor and a second of said cones is connected to said second conductor; and an antenna beam shaper section including a beam shaper having a beam shaper surface that is substantially convex and a conforming surface that is disposed in substantial conformity with a crotch defined between said two cones.

21. The antenna of claim 20 wherein said asymmetric cones are oblique cones.

22. The apparatus of claim 20 wherein said shape of said beam shaper surface is substantially spherical.

23. The apparatus of claim 22 wherein said cones are oblique circular cones.

24. The apparatus of claim 22 wherein said cones are oblique elliptical cones.

25. The antenna apparatus of claim 24 wherein said first beam shaper is of foam and said second beam shaper is of polyethylene.

26. The antenna apparatus of claim 20 wherein said beam shaper element is a first of first and second beam shaper elements wherein said first beam shaper element substantially surrounds said second beam shaper element, each of said beam shaper elements having different dielectric properties.

* * * * *